United States Patent [19]

Stearley

[11] 3,989,182

[45] Nov. 2, 1976

[54] VENTED BAG

[75] Inventor: Robert J. Stearley, Des Moines, Iowa

[73] Assignee: Great Plains Bag Corporation, Des Moines, Iowa

[22] Filed: Feb. 12, 1976

[21] Appl. No.: 657,454

[52] U.S. Cl. ..... 229/62.5; 229/DIG. 14

[51] Int. Cl.[2] ..... B65D 31/14

[58] Field of Search ..... 229/DIG. 14, 62.5; 150/9

[56] References Cited

UNITED STATES PATENTS

| | | | |
|---|---|---|---|
| 2,997,224 | 8/1961 | Stannard | 229/62.5 X |
| 3,117,711 | 1/1964 | Camerini | 229/62.5 X |
| 3,297,234 | 1/1967 | Honsel et al. | 229/62.5 |
| 3,370,780 | 2/1968 | Shaw | 229/62.5 |

*Primary Examiner*—Stephen P. Garbe

*Attorney, Agent, or Firm*—Zarley, McKee, Thomte, Voorhees & Sease

[57] ABSTRACT

A vented bag comprising a front wall, a back wall, and opposite end walls forming an enclosed container. Each of the end walls is comprised of first and second side flaps folded towards one another in an overlapping relationship and being adhered to one another. A pair of end flaps extend inwardly beneath the side flaps at the opposite ends thereof. One of the end walls is provided with a valve member which is positioned between one of the end flaps and the overlapped side flaps. A plurality of venting perforations are formed in at least one of the end walls for providing communication between the interior of the container and the atmosphere. A flat member is secured to the exterior surface of the said one end wall and is positioned over the venting perforations so that air from the interior of the container may escape therefrom outwardly through the vent perforations and outwardly between the end wall and the flap member.

6 Claims, 6 Drawing Figures

VENTED BAG

BACKGROUND OF THE INVENTION

This invention relates to a vented bag and more particularly to a block bottom valve bag having vents formed therein.

Block bottom valve bags or pasted bottom valve bags conventionally include valve members mounted in one end thereof. The valve members provide communication into the interior of the bag so that the bag may be filled by inserting a filling spout into the valve member and filling the bag by introducing the contents into the bag through the filling spout.

A problem encountered with the conventional bags, and particularly with plastic bags, is that the bag balloons during the time that it is being filled since air has great difficulty escaping from the bag during the filling operation. Furthermore, when the bag is dropped, if the air is not permitted to escape, the bag can often burst. Similarly, bursting can occur when the bags are stacked on one another.

Therefore, it is a principal object of the invention to provide an improved bag.

A still further object of the invention is to provide a vented bag.

A still further object of the invention is to provide a block bottom valve bag including a vent means in at least one end wall thereof.

A further object of the invention is to provide a vented bag which permits air to escape from the interior thereof when the bag is being filled, stored or dropped.

A still further object of the invention is to provide a vented bag which prevents the contents of the bag from inadvertently escaping therefrom.

A still further object of the invention is to provide a vented bag which is economical to manufacture, durable in use and refined in appearance.

DESCRIPTION OF THE PREFERRED EMBODIMENT

Figure 1:
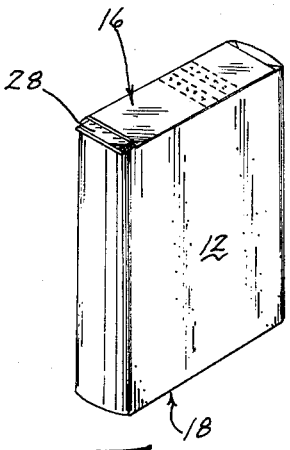
FIG. 1 is a top perspective view of the bag of this invention.
Figure 2:
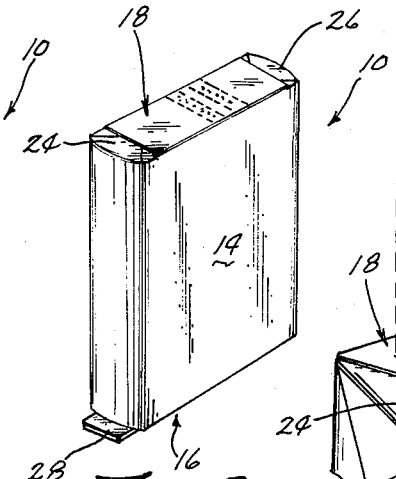
FIG. 2 is a bottom perspective view of the bag of this invention.
Figure 3:
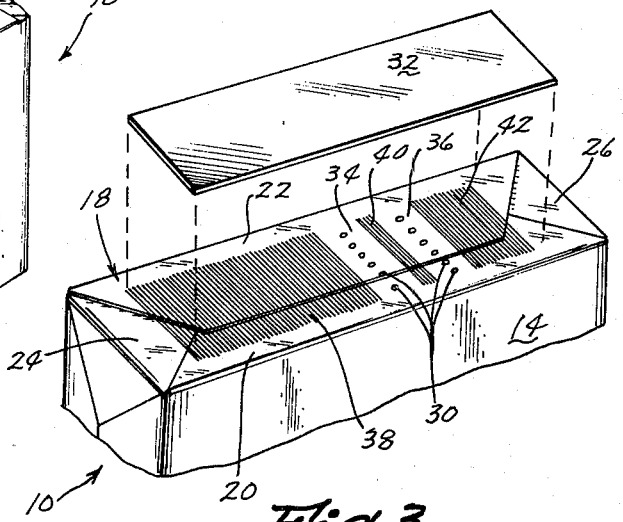
FIG. 3 is a partial exploded perspective view of the bag.
Figure 4:
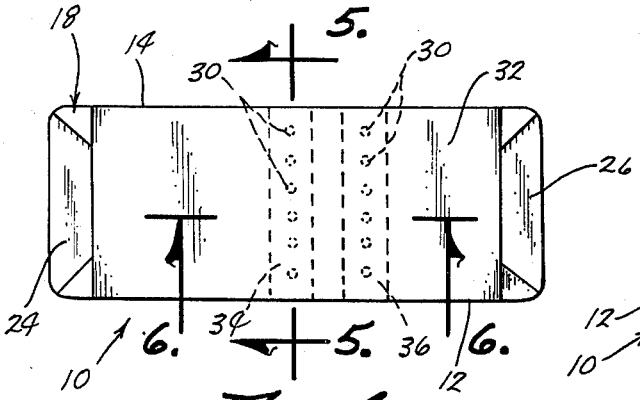
FIG. 4 is an end view of the bag.

Referring to the drawings, the numeral 10 generally designates a block bottom valve bag or pasted bottom valve bag of this invention. Bag 10 includes a front wall 12, rear wall 14, and end walls or closures 16 and 18. Bag 10 is formed from an elongated tube which may be of single ply or multi-ply construction.

Inasmuch as each of the end walls 16 and 18 are identical, only end wall 18 will be described in detail. End wall 18 is comprised of side flaps 20 and 22 which are folded towards one another in an overlapping relationship and which are adhered to one another by conventional means such as heat welding, adhesive, etc. End wall 18 also includes a pair of end flaps 24 and 26 which are extended inwardly beneath the side flaps 20 and 22 at the opposite ends thereof.

End wall 16 is provided with an elongated valve member 28 which extends between one of the end flaps and the overlapped side flaps thereon. The valve member 28 comprises an elongated flexible valve tube which is collapsed into a flat configuration. The inner end of the elongated valve member is in communication with the interior of the bag 10 to facilitate filling the bag.

Figure 5:
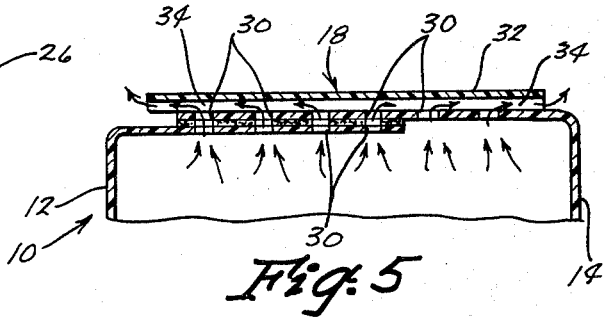
FIG. 5 is an enlarged sectional view as seen on lines 5—5 of FIG. 4.
Figure 6:
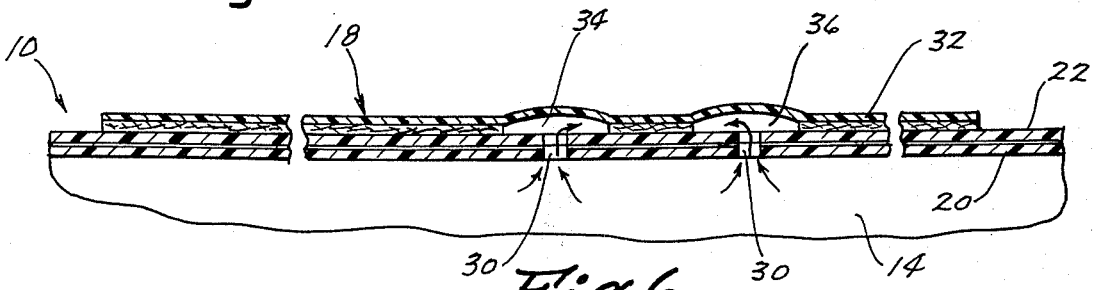
FIG. 6 is an enlarged sectional view as seen on lines 6—6 of FIG. 4.

End wall 18 is provided with a plurality of spaced-apart venting perforations 30 formed therein and which are arranged in spaced-apart rows disposed transversely to the plane of walls 12 and 14. As seen in FIG. 5, the perforations 30 extend through the overlapped side flaps to provide communication between the interior of the bag 10 and the atmosphere. The numeral 32 refers to a flat rectangular sheet member which is secured to end wall 18 by suitable means such as adhesive or the like so as to be positioned with respect to end wall 18 and the perforations 30 as illustrated in the drawings. When the sheet member 32 is adhesively secured over the perforations 30, elongated channels 34 and 36 are left unglued so as to permit the escape of air through the perforations 30 and outwardly through the channels 34 and 36 as illustrated in FIGS. 5 and 6. The glue areas are referred to generally be the reference numerals 38, 40 and 42.

The preferred embodiment comprises a pair of rows of perforations 30 but it should be understood that any given number of rows of openings may be utilized depending upon the particular situation. The drawings illustrate that venting perforations are also formed in both end walls but it should be understood that some bags will require perforations at only one end thereof.

In operation, a filling spout or the like would be extended through the valve member 28 to fill the bag 10. As the material is introduced into the interior of the bag, the air within the bag will escape outwardly through the perforations 30 and through the channels 34 and 36 to prevent the bag from ballooning. The fact that the air from the interior of the bag is vented during the filling operation also permits the bag to be filled at a faster rate than heretofore possible. Once the bag has been filled, the filling spout is removed. The relationship of the flexible member 32 with respect to the perforations 30 prevents the material in the bag from flowing outwardly through the perforations and the channels 34 and 36. If the bag is inadvertently dropped, the air within the interior of the bag can escape outwardly through the venting perforations 30 to prevent the bag from bursting. Likewise, the air within the interior of the bag can escape therefrom should the bags be stored one on top another.

Thus it can be seen that a novel vented bag has been provided which is especially well adapted for use with a pasted bottom or a block bottom valve bag. It can also be seen that the bag of this invention accomplishes at least all of its stated objectives.

I claim:

1. A vented bag comprising:

a front wall, a back wall, and opposite end walls forming an enclosed container;

at least one of said end walls having a plurality of venting perforations formed therein for providing communication between the interior of the container and the atmosphere;

said one end wall being comprised of first and second side flaps folded toward one another in an overlapping relationship and being adhered to one another;

said one end wall being further comprised of a pair of end flaps extending inwardly beneath said side flaps at the opposite ends thereof, said perforations extending through said side flaps, a flat member secured in overlapping position over said one end wall, and over said venting perforations, portions of said flat member being free from attachment to said one end wall to form channels between said end wall and said flat member which provide a communication from said perforations to the atmosphere whereby air from the interior of said container may escape outwardly through said vent perforations and said channels to the atmosphere.

2. A bag according to claim 1 wherein said perforations extend at least through the overlapped portions of said side flaps.

3. The bag of claim 1 wherein said venting perforations are arranged in spaced-apart parallel rows.

4. The bag of claim 1 wherein said flat member is adhesively secured to said one end wall except over said venting perforations.

5. The bag of claim 1 wherein venting perforations are also formed in the other end wall and wherein a flat member is also secured to the exterior surface of said other end wall.

6. The bag of claim 1 wherein a valve member is positioned between one of said end flaps and the overlapped side flaps.

* * * * *